US008925766B2

(12) United States Patent
Gray et al.

(10) Patent No.: US 8,925,766 B2
(45) Date of Patent: Jan. 6, 2015

(54) PEROXIDE POWERED PRODUCT DISPENSING SYSTEM

(75) Inventors: Robert L. Gray, Hudson, OH (US); Nick E. Ciavarella, Seven Hills, OH (US)

(73) Assignee: Gojo Industries, Inc., Akron, OH (US)

( * ) Notice: Subject to any disclaimer, the term of this patent is extended or adjusted under 35 U.S.C. 154(b) by 241 days.

(21) Appl. No.: 13/343,982

(22) Filed: Jan. 5, 2012

(65) Prior Publication Data

US 2013/0175296 A1 Jul. 11, 2013

(51) Int. Cl.

| | |
|---|---|
| ***B67D 7/76*** | (2010.01) |
| ***B67D 1/00*** | (2006.01) |
| ***B05B 7/12*** | (2006.01) |

(52) U.S. Cl.

USPC ..... 222/190; 222/1; 222/135; 222/23; 222/52; 222/325; 239/408; 239/410

(58) Field of Classification Search

USPC ..... 222/23, 52, 63, 55, 56, 61, 135, 145.1, 222/145.5, 145.7, 181.1, 181.2, 18, 1.3, 222/182, 183, 325, 94, 190, 105; 239/407, 239/408, 410, 303, 304

See application file for complete search history.

(56) References Cited

U.S. PATENT DOCUMENTS

| | | | | |
|---|---|---|---|---|
| 3,488,287 | A * | 1/1970 | Leonard et al. | 424/44 |
| 3,557,004 | A | 1/1971 | Yolles | |
| 3,581,504 | A | 6/1971 | Andrus | |
| 4,466,556 | A | 8/1984 | Sochting | |
| 5,285,486 | A | 2/1994 | Cowan, II et al. | |
| 5,518,145 | A | 5/1996 | Chen | |
| 5,544,788 | A * | 8/1996 | Meyer | 222/110 |
| 5,605,570 | A | 2/1997 | Bean et al. | |
| 5,832,972 | A | 11/1998 | Thomas et al. | |
| 5,971,210 | A | 10/1999 | Brugger | |
| 5,992,700 | A | 11/1999 | McGlothlin et al. | |
| 6,255,009 | B1 | 7/2001 | Rusek et al. | |
| 7,861,895 | B2 | 1/2011 | Ray | |
| 2005/0044851 | A1 | 3/2005 | Goldfarb et al. | |
| 2008/0060879 | A1 | 3/2008 | Orlitzky et al. | |
| 2010/0051642 | A1 * | 3/2010 | Wong et al. | 222/52 |
| 2010/0143265 | A1 | 6/2010 | Hewes et al. | |
| 2010/0219206 | A1 | 9/2010 | Ophardt | |
| 2010/0288788 | A1 | 11/2010 | Ophardt | |
| 2011/0101031 | A1 * | 5/2011 | Hagleitner | 222/190 |

OTHER PUBLICATIONS

Hydrogen Peroxide, Energy Independence Article, americanenergyindependence.com.

* cited by examiner

*Primary Examiner* — Kevin P Shaver
*Assistant Examiner* — Stephanie E Williams
(74) *Attorney, Agent, or Firm* — Renner, Kenner, Greive, Bobak, Taylor & Weber Co. LPA

(57) ABSTRACT

A dispensing system includes a decomposition chamber having a catalyst for the decomposition of hydrogen peroxide. The hydrogen peroxide and a foaming soap are provided in separate first and second chambers of a product reservoir portion of a refill unit. Decomposition of the hydrogen peroxide produces oxygen gas and water, that may be used as a propellant for the creation of the foamed product, or may be used to power a pump. Additionally, the oxygen gas may be used to power a scavenger for the creation of electricity for charging a battery within the dispenser.

21 Claims, 5 Drawing Sheets

PEROXIDE POWERED PRODUCT DISPENSING SYSTEM

FIELD OF THE DISCLOSURE

The present disclosure relates generally to dispensing systems and methods. More particularly, the present disclosure relates to a system and method for dispensing liquid or foam product using the decomposition of hydrogen peroxide as a power source and/or using the byproducts of the decomposition in the formation of the dispensed product.

BACKGROUND OF THE DISCLOSURE

It is well known to provide fluid dispensers for use in restaurants, factories, hospitals, bathrooms and the home. These dispensers may contain one of a number of products such as, for example, soap, anti-bacterial cleansers, disinfectants, and lotions. Dispensers often include some type of manual pump actuation mechanism where the user pushes or pulls a lever to dispense a quantity of fluid, as is known in the art. Alternatively, "hands-free" automatic dispensers may also be utilized where the user simply places one or both hands underneath a sensor and a quantity of fluid is dispensed. Similar types of dispensers may be used to dispense powder or aerosol materials.

Product dispensers are commonly configured to be mounted to a wall or other vertical surface, with the product being dispensed from an outlet near the bottom of the dispenser. It is also known that dispensers may be integrated into a countertop near a sink basin, with certain components of the dispensing system being located beneath the countertop, and other components, including an outlet, being located above the countertop. These types of dispensers are often referred to as counter-mount dispensing systems. Various other configurations of dispensers are also known, including table-top style dispensers that rest on a horizontal surface such as a counter or table top, or stand mounted dispensing systems that attach to a mounting pole.

In the case of automatic "hands free" dispensers, a power source may be required to supply power to the pump, sensors, valves, communication devices, and video screens of the dispenser. Conventional power sources include replaceable batteries, an external power supply, or solar power. The most common of these power sources are batteries, which are provided within the dispenser. Battery power supplies suffer from a number of disadvantages, including being large in size, thereby requiring a larger dispenser to accommodate the batteries, as well as requiring routine maintenance to replace the batteries. Larger dispensers are more expensive to manufacture, and may present difficulties during installation where wall or counter space is limited. Other types of power supplies, such as external power supplies and solar power supplies, while not subject to the disadvantages of batteries, suffer from their own disadvantages, such as being difficult and expensive to install.

The size of foam product dispensing systems is also often increased by the need for an air pump to draw air into a mixing chamber to generate the foam. This is in addition to the added size to accommodate batteries where a battery power supply is provided. As discussed above, this increased size of the dispenser is not desirable. Also adding to the size of dispensers is the volume of product provided in refill units. While larger volume refills are advantageous in that they require less frequent replacement, they also further add size to the dispenser.

Thus, there is a need for an improved system and method for dispensing foam and liquid products that alleviates one or more of the deficiencies discussed above.

SUMMARY OF THE DISCLOSURE

In general, a dispensing system according to the present disclosure includes a decomposition chamber containing a catalyst for the decomposition of hydrogen peroxide; a mixing chamber; a first pump for pumping a foaming soap concentrate into said mixing chamber; a second pump for pumping hydrogen peroxide into said decomposition chamber; and a passage extending between said decomposition chamber and said mixing chamber for providing oxygen gas and water produced from the decomposition of the hydrogen peroxide to said mixing chamber.

In accordance with at least one aspect of the present disclosure, a refill unit for a foam product dispenser includes a first chamber containing a foaming soap concentrate; and a second chamber containing hydrogen peroxide.

In accordance with at least one aspect of the present disclosure, a method of dispensing a foam product includes introducing hydrogen peroxide into a decomposition chamber containing a catalyst to decompose the hydrogen peroxide and produce water and oxygen gas; introducing the oxygen gas and water into a mixing chamber; introducing a foaming soap concentrate into the mixing chamber to mix with the oxygen gas and water and form a foamed product; and dispensing the foamed product.

In accordance with at least one aspect of the present disclosure, a dispensing system includes a decomposition chamber containing a catalyst for the decomposition of hydrogen peroxide to produce oxygen gas and water; a foaming soap pump in fluid communication with a foaming soap reservoir; a passage extending between the decomposition chamber and the foaming soap pump; a scavenger for generating electricity; a passage extending between the decomposition chamber and the scavenger; and a rechargeable battery in communication with the scavenger.

BRIEF DESCRIPTION OF THE DRAWINGS

For a full understanding of the apparatus and methods of the present disclosure reference should be made to the following detailed description and the accompanying drawings, wherein.

DETAILED DESCRIPTION OF THE ILLUSTRATIVE EMBODIMENTS

Figure 1:
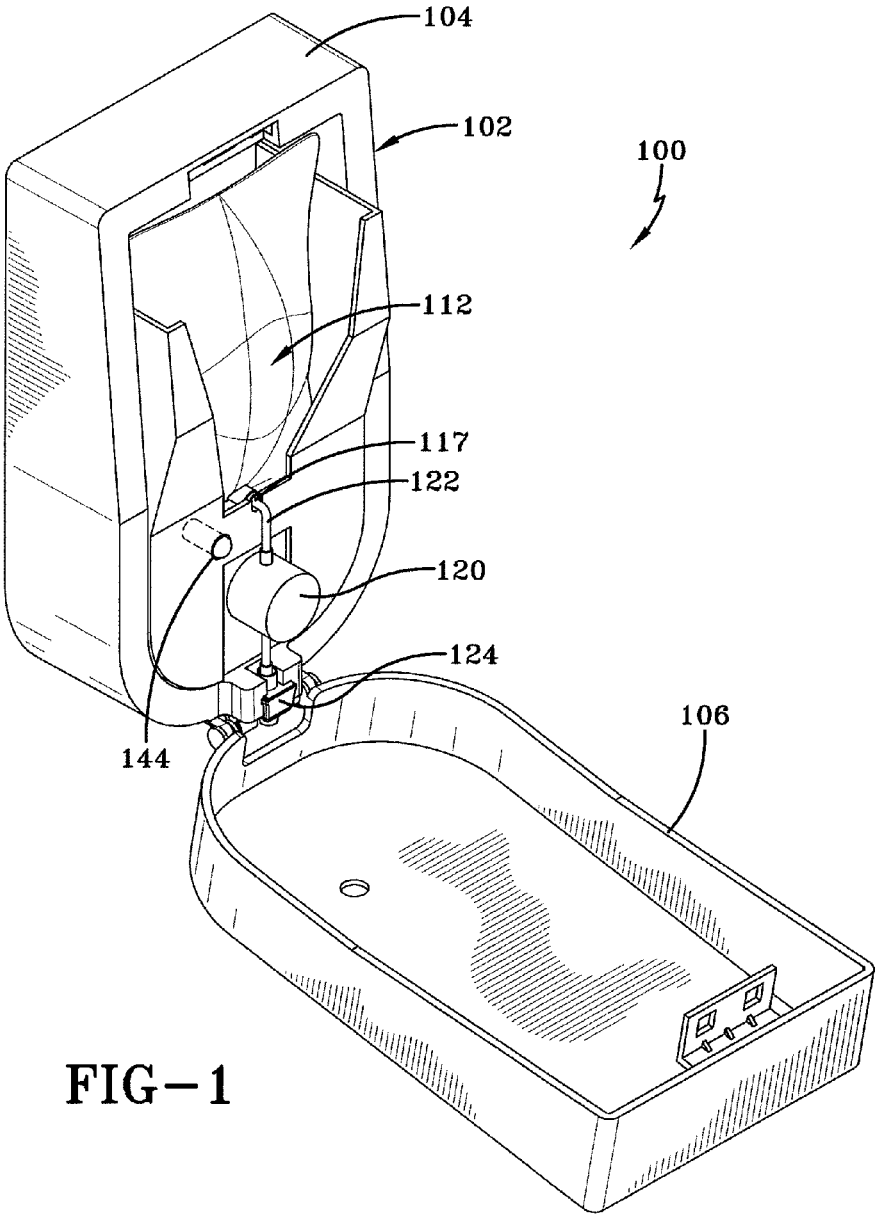
FIG. 1 is a perspective view of a dispensing system according to the concepts of the present disclosure.
Figure 2:
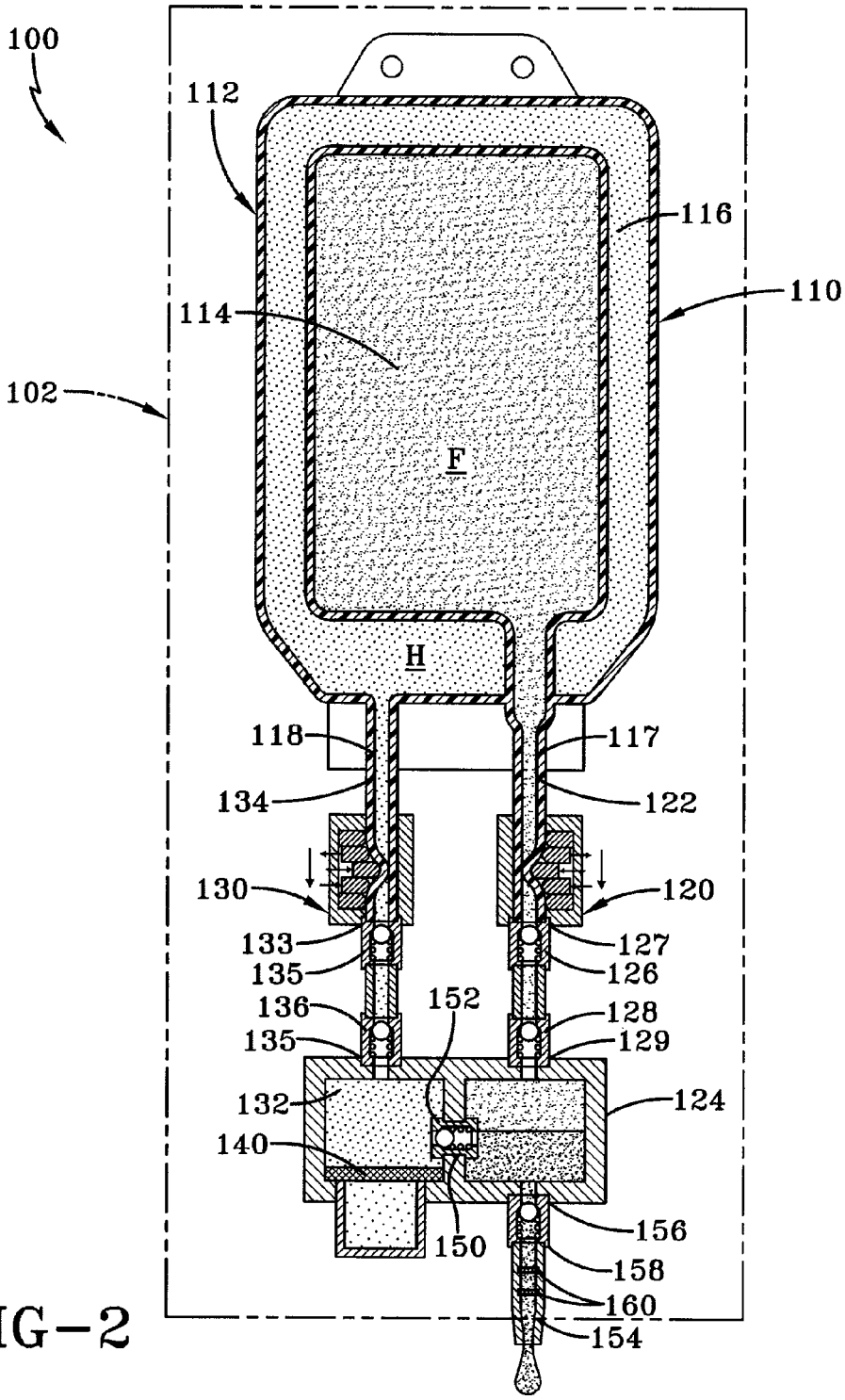
FIG. 2 is a sectional view of a dispensing system including a decomposition chamber according to the concepts of the present disclosure.

Referring now to FIG. 1, a dispenser is shown and is generally indicated by the numeral 100. Dispenser 100 includes a housing 102 that surrounds and protects the internal components of the dispenser. Housing 102 may be provided in any desired form. In one or more embodiments, housing 102 may include a backplate 104 and a cover 106 pivotally or otherwise movably secured to the backplate to allow for replacement of a refill unit within the housing 102. Backplate 104 may be adapted to be secured to a wall or other surface. Dispenser housings are well known in the art, and any known variation of a dispenser housing may be employed with the dispenser 100. The refill unit 110 is removably secured within housing 102 and may contain a volume of product to be dispensed by the dispenser 100.

Refill unit 110 includes a dual chamber product reservoir 112. Product reservoir includes a first chamber 114 having a foaming soap concentrate F disposed therein, and a second chamber 116 having hydrogen peroxide H ($H_2O_2$) disposed therein. The first and second chambers 114, 116 of product reservoir 112 are separate and not in fluid communication with one another. Each of the first and second chambers 114, 116 includes an outlet port 117, 118, respectively, that is in fluid communication with a pump, as will be discussed below.

The foaming soap concentrate F contained within first chamber 114 may be any foamable soap concentrate known to those skilled in the art with a reduced water content. In one or more embodiments, the foamable soap concentrate F has a water content that is less than the usual water content of the foamable soap composition used in conventional dispensers. For example, in certain embodiments the foamable soap composition F may have a water content that is between approximately 50 and 90% of the typical water content for the foamable soap composition, in other embodiments between approximately 60 and 80% of the typical water content for the foamable soap composition, and in other embodiments approximately 70% of the water content of the typical water content for the foamable soap composition. For example, if a conventional or typical non-concentrate foaming soap composition includes water in an amount equal to approximately 85% by weight, the composition may be modified to form a concentrate for use in the dispensing system of the present disclosure by including an amount of water equaling approximately 60% by weight.

The hydrogen peroxide H provided in the second chamber 116 of the product reservoir 112 may be of any desired concentration suitable for use in a dispenser 100 as described herein. In certain embodiments, the hydrogen peroxide H may have a concentration of less than 30%, in other embodiments less than 20%, and in other embodiments less than 10%. In the same or other embodiments, the hydrogen peroxide H may have a concentration of greater than 3%, in other embodiments greater than 4%, and in other embodiments greater than 5%. In a particular embodiment, the hydrogen peroxide H may have a concentration of approximately 6%.

Dispenser 100 includes a first pump 120 located within housing 102 that is configured to pump the foamable soap concentrate F from the first chamber 114. First pump 120 may be any type of pump known to those skilled in the art. In a particular embodiment, first pump 120 may be either a rotational or linear peristaltic pump. Peristaltic pumps are well known to those skilled in the art, and the structure and operation of a peristaltic pump will therefore not be described in detail here. An exemplary linear peristaltic pump suitable for use in the present disclosure is disclosed in U.S. Pat. No. 5,980,490, which is incorporated herein by reference for the purpose of teaching the structure and operation of a suitable peristaltic pump.

First pump 120 pumps the foamable soap concentrate F from the first chamber 114 through a conduit or passage 122 and into a mixing chamber 124 formed within housing 102. A one-way valve 126 may be provided at the exit port 127 of the first pump 120 to prevent fluid flow in a reverse direction toward first chamber 114 and away from mixing chamber 124. Another one-way valve 128 may be provided at the entrance port 129 of the mixing chamber 124 to prevent foamable soap concentrate F within the mixing chamber from being forced back through conduit 122.

A second pump 130 is provided within housing 102 and is configured to pump the hydrogen peroxide H into a decomposition chamber 132. The second pump 130 may be any type of pump known to those skilled in the art. In certain embodiments, the second pump 130 may be a rotational or linear peristaltic pump identical or similar to first pump 120. Second pump 130 pumps the hydrogen peroxide H from the second chamber 116 through a conduit or passage 134 and into the decomposition chamber 132. One way valves 135 and 136 may be provided at the exit port 133 of the second pump 130 and adjacent to an entrance port 135 of the decomposition chamber 132, respectively, to ensure only one-way flow of the hydrogen peroxide H.

Decomposition chamber 132 includes a catalyst 140 to cause decomposition of the hydrogen peroxide. As is known to those skilled in the art, the decomposition of hydrogen peroxide produces oxygen gas and water. Catalysts for causing the decomposition of the hydrogen peroxide are well known, and may include, for example, manganese dioxide, silver, or platinum. In a particular embodiment, a mesh having a silver coating is provided within the decomposition chamber as a catalyst 140.

A controller (not shown) may be provided to control the activation of the first and second pumps 120 and 130 based upon feedback received from one or more proximity sensors 144 adapted to actuate the dispenser. The controller may also receive feedback from a pressure sensor within the decomposition chamber 132 to maintain a constant pressure of oxygen gas within the decomposition chamber. The structure and function of the controller and sensors are well known, and are therefore not described in detail herein. The flow rate of hydrogen peroxide H into the decomposition chamber 132 may be controlled to maintain a desired pressure within the chamber.

A power source may be provided to provide power to the controller, pumps, valves, and other components of the dispensing system as necessary. In one or more embodiments, the power source may be a battery.

An outlet port 150 of the decomposition chamber 132 is in fluid communication with the mixing chamber 124. A one-way valve 152 may be provided in or adjacent the outlet port 150 to control the flow of water and oxygen gas from the decomposition chamber 132 and into the mixing chamber 124. One-way valve 152 may be a solenoid valve or other controllable valve mechanism that is in communication with the controller. Upon activation of the first pump 120 to pump the foamable soap concentrate F into the mixing chamber 124, the one-way valve 152 may also be opened to allow a volume of water and/or oxygen gas to enter the mixing chamber 124. The water mixes with the foamable soap concentrate F to form a foamable composition having a desired water content, and the air mixes with the foamable composition to generate a foam product. In this way a separate air pump may be omitted from the dispenser 100 because the decomposition of hydrogen peroxide provides both the water to dilute the concentrate and the oxygen gas needed to form a foam product.

A dispensing nozzle 154 extends from an outlet port 156 of the mixing chamber 124 and is adapted to provide the foam product to a user. A one-way valve 158 may be provided in or adjacent to the outlet port 156 to control the flow of fluid from the mixing chamber. One or more mesh screens 160 may be provided within dispensing nozzle 154 to create a shearing force on the exiting foam product, thereby increasing the air content within the foam product dispensed.

As is apparent from the above description, the dispenser 100 as described eliminates the need for an additional air pump in a foam product dispenser through use of the oxygen gas produced from the decomposition of the hydrogen peroxide. In addition, a greater amount of foamable soap product F can be provided, in concentrate form, due to the availability of the water byproduct produced from the decomposition of the hydrogen peroxide. As will be appreciated by those skilled in the art, dispenser 100 may be modified in various ways to enhance the performance and efficiency of the system. The operation and timing of the pumps and valves may be controlled by the controller to optimize performance and to improve the quality of foam product produced. Any known valve mechanisms and sensors may be used to achieve optimum performance of the dispenser 100.

In operation, hydrogen peroxide H may be pumped from the second chamber 116 and into the decomposition chamber 132 as needed to maintain a desired pressure within the decomposition chamber. Thus, a pressurized volume of oxygen gas and water is available as needed for the formation of a foam product. The foaming soap concentrate F may be pumped from the first chamber 114 into the mixing chamber 124 upon activation of a proximity sensor 144. Oxygen gas and water may be introduced into the mixing chamber from the decomposition chamber through the outlet port 150 and the one-way valve 152 upon activation of the first pump 120. The pressurized oxygen gas acts as a propellant to mix the oxygen, water, and foaming soap concentrate within the mixing chamber and to force the foamed product from the mixing chamber and into the dispensing nozzle 154 and through the one or more mesh screens 160. In this way, a foamed product is formed and dispensed to a user.

Figure 3:
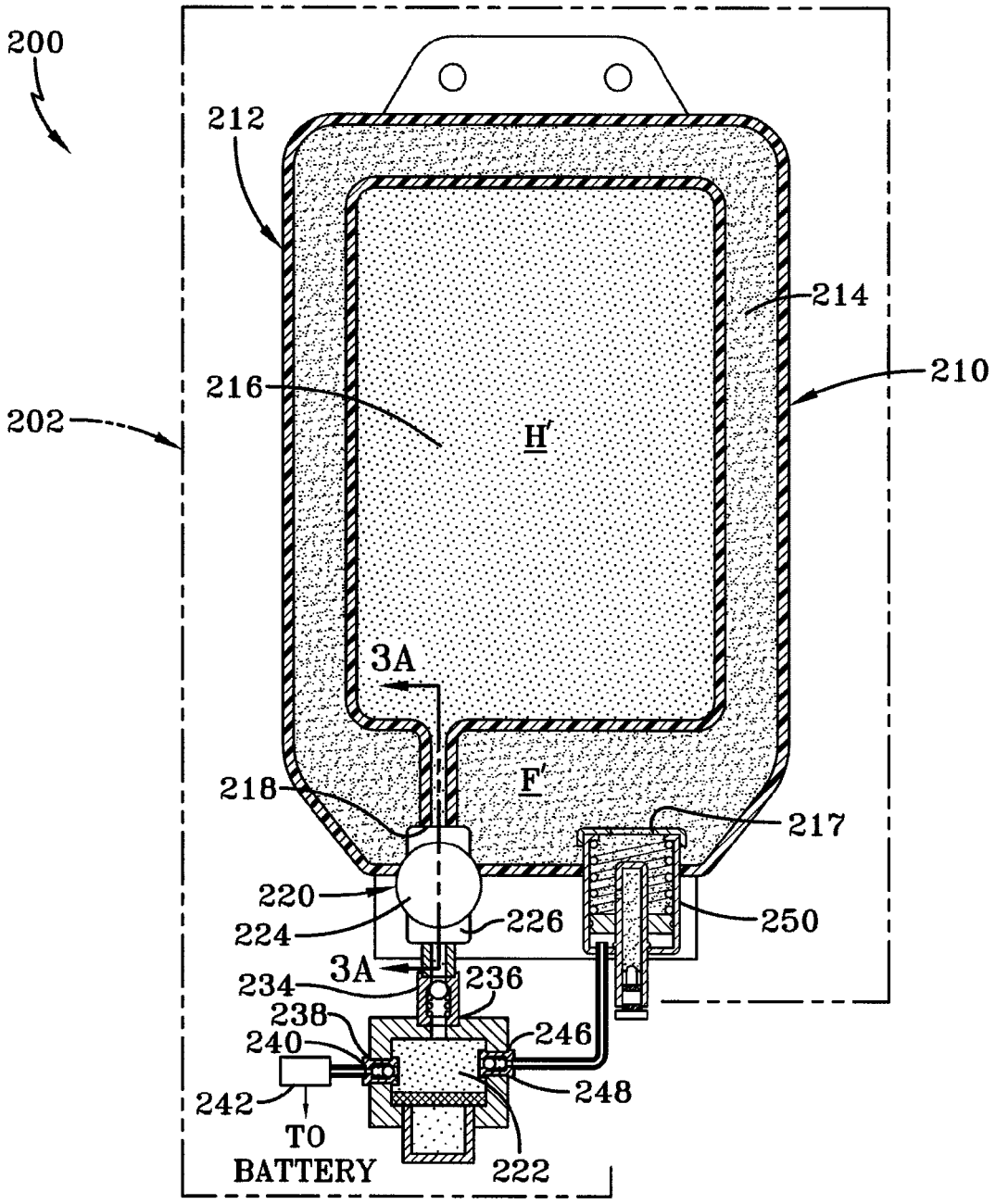
FIG. 3 is a sectional view of another embodiment of the dispensing system according to the concepts of the present disclosure.
Figure 3A:
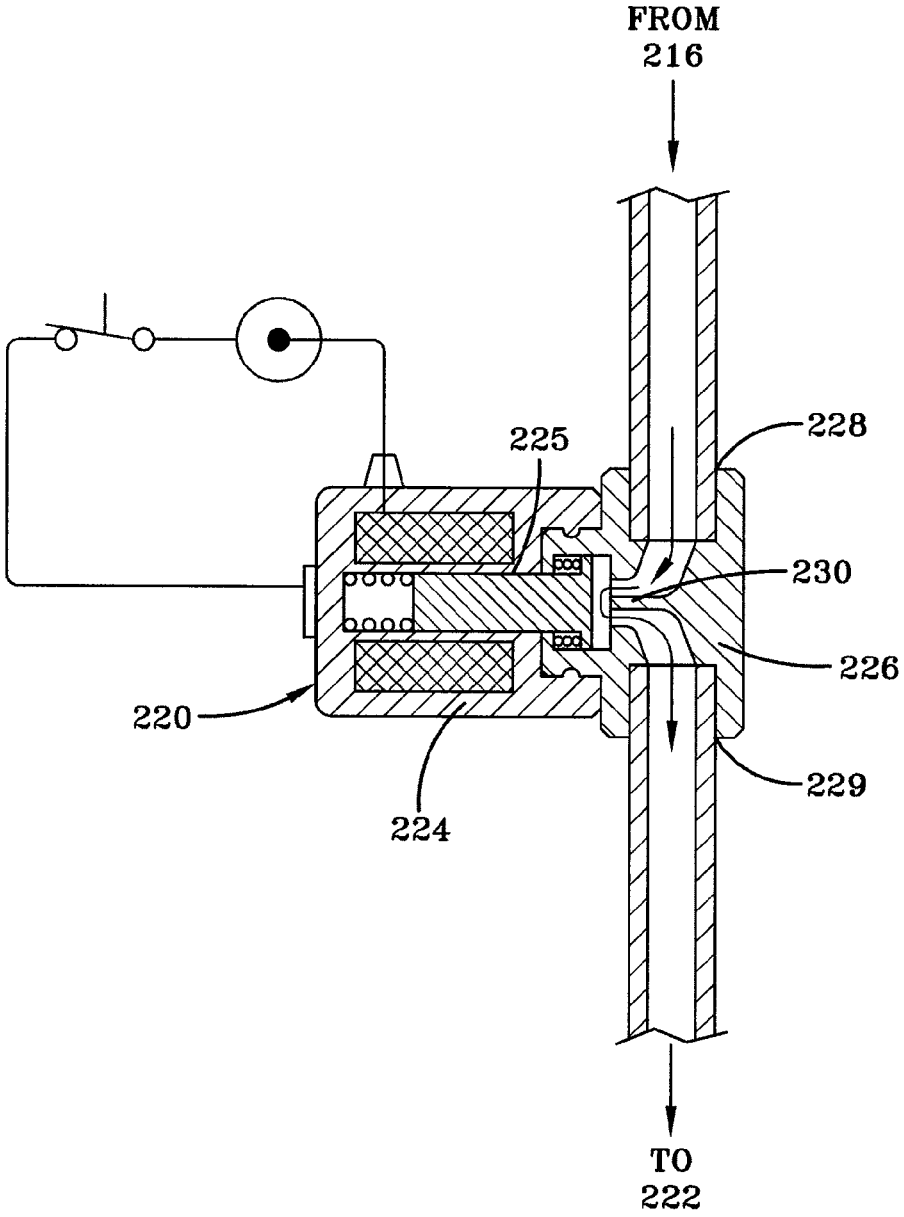
FIG. 3A is a sectional view of the solenoid valve of FIG. 3.
Figure 4:
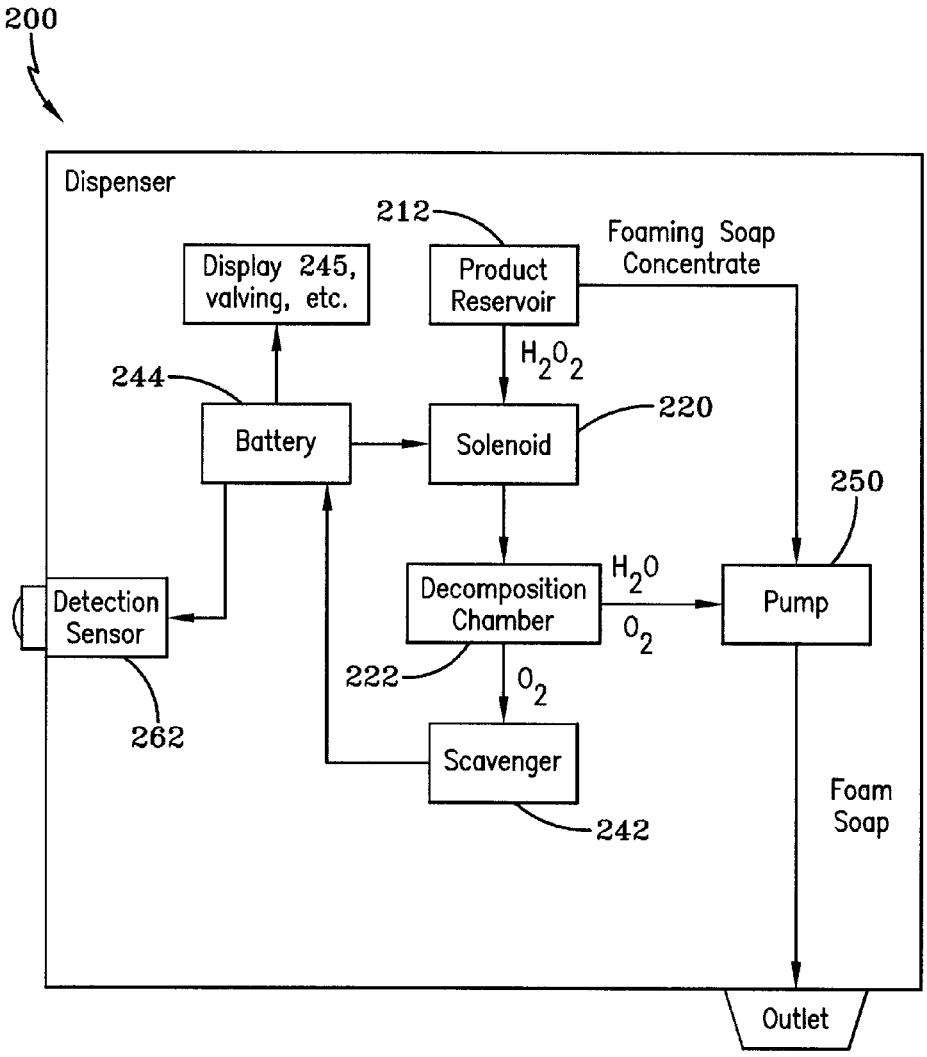
FIG. 4 is a schematic block diagram of the components of the dispensing system shown in FIG. 3.

Referring now to FIGS. 3-4, a second embodiment of the dispenser of the present disclosure is shown and is generally indicated by the numeral 200. Dispenser 200 is similar in many respects to dispenser 100 discussed above. The dispenser 200 includes a housing 202 that surrounds and protects the components of the dispenser. A refill unit 210 is removably secured within the housing 202, the refill unit including a product reservoir 212. Product reservoir includes a first chamber 214 containing a foaming soap concentrate F' and a second chamber 216 containing hydrogen peroxide H'. First and second chambers 214 and 216 are separate and are not in fluid communication with one another. Each of the first and second chambers 214 and 216 includes an outlet port 217, 218, respectively, that is in fluid communication with a pump or valve, as will be discussed below.

A solenoid valve 220, also referred to as an electromechanical valve, may be provided to control the dispensing of the hydrogen peroxide H' from the second chamber 216 into a decomposition chamber 222. Solenoid valves are well known to those skilled in the art, and are therefore not described in detail here. It is contemplated that any known type of solenoid valves, or other suitable valves, may be utilized to control dispensing of the hydrogen peroxide H' from the second chamber 216 and into the decomposition chamber 222. U.S. Patent Publication No. 2009/0072174 discloses the basic structure and operation of a solenoid valve and is incorporated herein by reference for that purpose.

In the embodiment disclosed in FIGS. 3-4 and described herein, a portion 224 of the solenoid valve 220, including the magnetic coil and pushrod 225, is secured to or is part of the dispenser housing 202. Thus, this portion of the solenoid valve does not require replacement when a new refill unit 210 is installed. A second portion 226 of the valve 220 is integral with the refill unit 210, and is therefore discarded when the refill unit is empty. The second portion 226 of the solenoid valve includes an inlet passage 228 and an outlet passage 229 separated by a flow divider 230 that is in contact with the pushrod 225 when the second portion 226 is installed in the housing 202. As will be appreciated by those skilled in the art, actuation of the solenoid causes the pushrod 225 to move away from the flow divider 230, thereby allowing hydrogen peroxide H' to flow from the second chamber 216 and into the decomposition chamber 222.

The decomposition chamber 222 includes a catalyst to cause decomposition of the hydrogen peroxide within the decomposition chamber, thereby producing water and oxygen gas as byproducts. As discussed above, suitable catalysts are well known, and include manganese dioxide, silver, or platinum. A one-way valve 234 may be provided at an inlet port 236 of the decomposition chamber allowing hydrogen peroxide H' to flow into the chamber. In addition, a pressure sensor (not shown) may be provided in decomposition chamber 222 to monitor the pressure of the oxygen gas produced by decomposition of the hydrogen peroxide H'. The flow of hydrogen peroxide H' into the decomposition chamber may be regulated by a controller (not shown) to maintain a substantially steady internal pressure within the decomposition chamber 222.

A first outlet port 238 in decomposition chamber 222 includes a one-way valve 240 and is in fluid communication with a thermal and/or mechanical scavenger 242 (also referred to as an energy harvester) for producing electric energy from the high pressure oxygen gas generated during decomposition. The scavenger 242 may be any known scavenger suitable for use in the dispenser 200 of the present disclosure. The scavenger 242 utilizes the pressure and/or heat of the oxygen gas produced during decomposition of the hydrogen peroxide to generate electricity. Those skilled in the art will appreciate that suitable scavengers may include liquid-to-liquid, liquid-to-air, and solid-to-air energy harvesters. One example of a suitable energy harvester for use with the dispenser of the present disclosure is the Evergen solid-to-air energy harvesting device manufactured by Marlow Industries, Inc. (Dallas, Tex.). This scavenger harvests the thermal energy between a higher temperature solid surface and ambient air via natural convection for conversion to electrical power.

A rechargeable battery, or batteries, 244 may be provided within dispenser 200 and may be used to power the solenoid valve 220 and other valving, sensors, displays 245, and communication devices that may be provided. In one or more embodiments, the battery 244 may be charged by energy generated by the scavenger 242, thereby eliminating the need for routine replacement of the battery. The rechargeable nature of the battery also allows smaller or less numerous batteries to be used, as compared to conventional battery power supplies.

A second outlet port 246 in the decomposition chamber 222 includes a one-way valve 248 and is in fluid communication with a pump 250. Pump 250 is in fluid communication with the first fluid chamber 214 containing the foaming soap concentrate F'. The pump 250 may be a pressure actuated pump, such as, for example, the pump disclosed in U.S. Pat. No. 7,861,895, which is incorporated herein by reference in its entirety for the purpose of teaching the structure and operation of a suitable pump.

Pressurized oxygen gas provided from decomposition chamber 222 may be utilized to power the pump 250. The one-way valve 246 controls flow of the pressurized oxygen gas from the decomposition chamber to the pump 250, opening of the valve 248 allowing pressurized oxygen gas to flow into a pressure chamber within the pump 250 to actuate the pump and cause dispensing of the foaming soap product. The pump of U.S. Pat. No. 7,861,895 also allows the pressurized oxygen gas, and water, provided from the decomposition chamber 222 to mix with the foaming soap concentrate F' upon actuation of the pump to form a foam product. Alternatively, where a liquid product is to be dispensed, this feature may be eliminated from the pump. A controller may be provided to control operation and timing of the components of the dispenser based upon signals received from one or more of the proximity sensors 262 and pressure monitoring sensors (not shown).

In operation, hydrogen peroxide H' may be provided to decomposition chamber 222 in an amount sufficient to maintain a desired pressure within the chamber. Introduction of hydrogen peroxide H' into the decomposition chamber 222 is controlled by solenoid valve 220. When pressurized oxygen gas is released from the decomposition chamber to power the scavenger 242 or pump 250, additional hydrogen peroxide H' is allowed to flow into the chamber 222 by opening solenoid valve 220, thereby replenishing the oxygen gas and water levels by decomposition of the hydrogen peroxide H'. Activation of a proximity sensor 262 indicating the presence of a user may cause one-way valve 246 to open for a predetermined time to allow an ideal amount of pressurized oxygen and water to pass therethrough. The pressurized oxygen activates the pump 250 to cause dispensing of a product, and the oxygen gas and water may then mix with the foaming soap concentrate F' to form a foamed product for dispensing. One-way valve 240 may be opened at regular intervals or as needed to provide pressurized oxygen to the scavenger 242 for energy generation and recharging of the battery 244.

As will be appreciated by those skilled in the art, the second embodiment also reduces the size of the dispenser by eliminating the need for a separate air pump in the case of a foam product dispenser, and reducing the size of the required batteries. In addition, the ability to use a concentrated foaming soap due to the availability of water, from decomposition of the hydrogen peroxide, allows a greater amount of soap to be provided in less space.

It is thus evident that a dispenser constructed as described herein substantially improves the art. In accordance with the Patent Statutes, only the best mode and preferred embodiment have been presented and described in detail. The disclosure should not be limited by the drawings or the description provided herein. For an appreciation of the true scope and breadth of the disclosure, reference should be made only to the following claims.

The invention claimed is:

1. A dispensing system comprising:

(a) a decomposition chamber containing a catalyst for the decomposition of hydrogen peroxide;

(b) a mixing chamber;

(c) a first pump for pumping a foaming soap concentrate into said mixing chamber;

(d) a second pump for pumping hydrogen peroxide into said decomposition chamber; and (e) a passage extending between said decomposition chamber and said mixing chamber for providing oxygen gas and water produced from the decomposition of the hydrogen peroxide to said mixing chamber.

2. The dispensing system of claim 1, said first pump being a peristaltic pump.

3. The dispensing system of claim 1, said second pump being a peristaltic pump.

4. The dispensing system of claim 1, further comprising a one-way valve positioned in said passage and allowing fluid flow toward said mixing chamber.

5. The dispensing system of claim 1, further comprising a refill unit including a product reservoir.

6. The dispensing system of claim 5, said product reservoir having a first chamber containing a foaming soap and a second chamber containing hydrogen peroxide.

7. The dispensing system of claim 6, said first and second chambers being separate from one another.

8. The dispensing system of claim 6, said foaming soap being a concentrate having a reduced water content.

9. The dispensing system of claim 6, said hydrogen peroxide having a concentration of less than 10%.

10. The dispensing system of claim 9, said hydrogen peroxide having a concentration of greater than 3%.

11. A refill unit for a foam product dispenser comprising a product reservoir having:

(a) a first chamber containing a foaming soap concentrate; and (b) a second chamber containing hydrogen peroxide.

12. The refill unit of claim 11, said first and second chambers being separate and not in fluid communication with one another.

13. The refill unit of claim 11, said first chamber including an outlet port for fluid communication with a first pump.

14. The refill unit of claim 11, said second chamber including an outlet port for fluid communication with a second pump.

15. The refill unit of claim 11, said foaming soap being a concentrate having a reduced water content.

16. The dispensing system of claim 11, said hydrogen peroxide having a concentration of less than 10%.

17. The dispensing system of claim 11, said hydrogen peroxide having a concentration of greater than 3%.

18. A method of dispensing a foam product comprising the steps of:

(a) introducing hydrogen peroxide into a decomposition chamber containing a catalyst to decompose the hydrogen peroxide and produce water and oxygen gas;

(b) introducing the oxygen gas and water into a mixing chamber;

(c) introducing a foaming soap concentrate into the mixing chamber to mix with the oxygen gas and water and form a foamed product; and (d) dispensing the foamed product.

19. The method of claim 18, further comprising the step of powering a foaming soap pump using the oxygen gas produced from the decomposition of hydrogen peroxide, the foaming soap pump pumping the foaming soap concentrate from a reservoir into the mixing chamber.

20. The method of claim 18, wherein the step of decomposing the hydrogen peroxide is performed using one of the catalysts selected from the group of manganese dioxide, silver, or platinum.

21. The method of claim 18, wherein the step of introducing hydrogen peroxide into a decomposition chamber is performed by pumping the hydrogen peroxide from a second chamber of a product reservoir, and the step of introducing the foaming soap is performed by pumping the foaming soap from a first chamber of the product reservoir, the first and second chambers being part of a single product reservoir but separate and not in fluid communication with one another.

* * * * *